US006486423B1

(12) United States Patent
Karasik et al.

(10) Patent No.: US 6,486,423 B1
(45) Date of Patent: Nov. 26, 2002

(54) SLIDING CONTACT MECHANISM

(75) Inventors: Vladimir Karasik, Walled Lake, MI (US); Sheldon J. Allen, Southfield, MI (US); Joseph Khoury, Farmington, MI (US)

(73) Assignee: Methode Electronics, Inc., Chicago, IL (US)

( * ) Notice: Subject to any disclaimer, the term of this patent is extended or adjusted under 35 U.S.C. 154(b) by 112 days.

(21) Appl. No.: 09/588,819

(22) Filed: Jun. 7, 2000

(51) Int. Cl.[7] ..... H01H 3/16; H01H 1/12

(52) U.S. Cl. ..... 200/61.62; 200/61.71; 200/61.81; 200/241; 200/279

(58) Field of Search ..... 200/61.62–61.83, 200/61.27, 11 R–11 TW, 237–261, 275, 279

(56) References Cited

U.S. PATENT DOCUMENTS 3,591,740 A * 7/1971 Koister ..... 200/61.27
3,659,063 A * 4/1972 Peterson ..... 200/61.7
4,527,023 A * 7/1985 Ohashi et al. ..... 200/11 G
4,556,765 A * 12/1985 Shaw et al. ..... 200/61.71
5,960,939 A * 10/1999 Miki et al. ..... 200/257

FOREIGN PATENT DOCUMENTS

GB 1 247 187 9/1971
GB 2169143 7/1986

* cited by examiner

*Primary Examiner*—J. R. Scott
(74) *Attorney, Agent, or Firm*—Seyfarth Shaw

(57) ABSTRACT

A sliding contact mechanism includes a sliding door contact, a spring having one end connected to the sliding door contact and another end connected to the sliding door of a mini-van, and a pillar contact attached to the stationary pillar of the mini-van. The pillar contact has a shape complementary to a shape of the sliding door contact. When the sliding door is in a closed position, the sliding door is adjacent the pillar and the sliding door contact engages and is in a closed electrical connection with the pillar contact. When the sliding door is in an open position, the sliding door is not adjacent the pillar and the sliding door contact is an open electrical connection with the sliding door contact.

19 Claims, 7 Drawing Sheets

Fig. 10
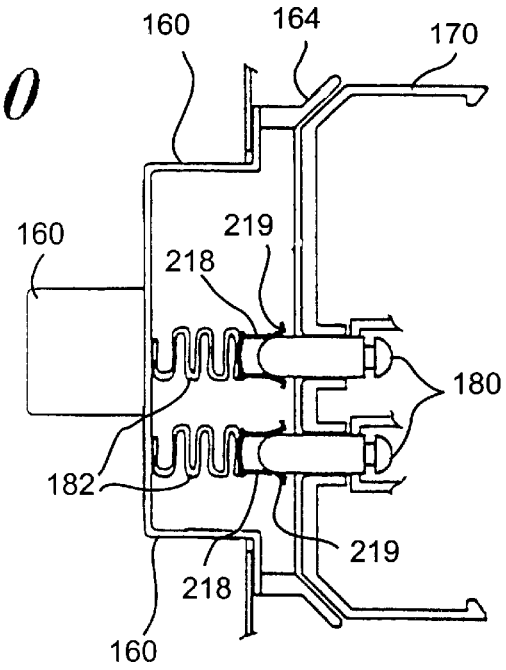
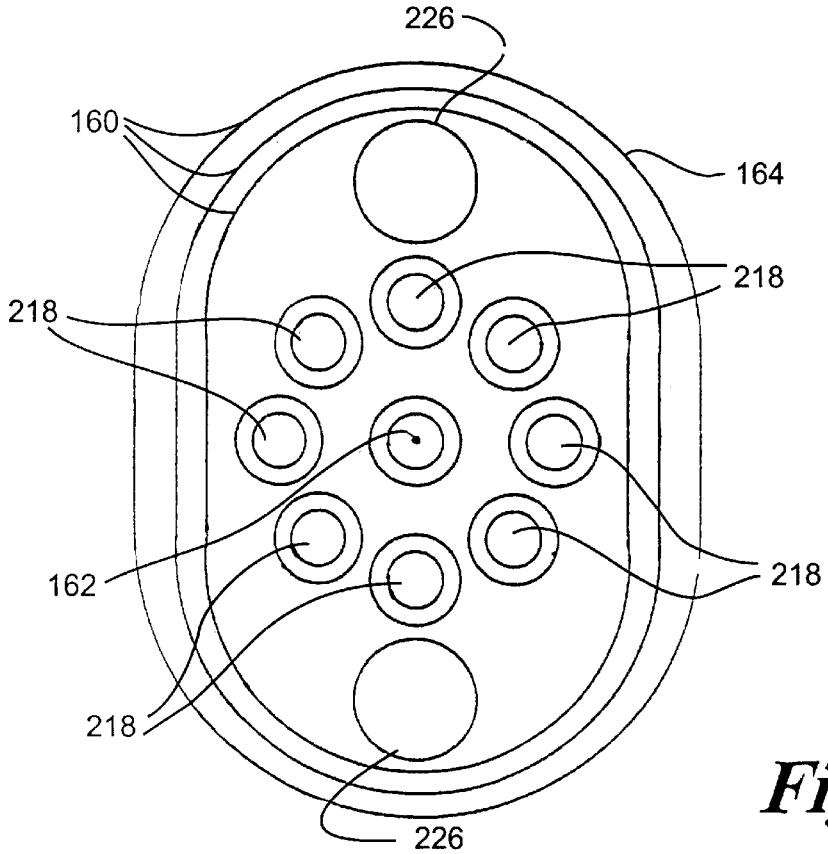
Fig. 11

SLIDING CONTACT MECHANISM

BACKGROUND OF THE INVENTION

1. Field of the Invention

The present invention relates to intermittent electrical contacting mechanisms used in automotive applications. The invention more particularly concerns the electrical connection between a sliding door of a vehicle and an adjacent stationary pillar of the vehicle so as to provide electrical current to devices mounted on the sliding door when the sliding door is closed, which is when the sliding door is adjacent the pillar.

2. Discussion of the Background

The present-day-consumer of automotive vehicles is conscious of quality and value. Consumers demand that amenities once reserved for luxury automobiles be included in vehicles as popular as so-called mini-vans. A mini-van is smaller than a full-sized van. The mini-van drives more like a car, but is larger than a car. Additionally, a mini-van can fit in a parking spot sized for a car. Thus, mini-vans have a large demographic appeal, especially, among parents having children. Typically, automotive manufacturers target the sale of mini-vans to such families that are thinking of replacing their car with a larger vehicle. However, this group of consumers does not want to forgo the amenities to which they became accustomed in their cars.

Most mini-vans have at least one large sliding door formed on a side of the vehicle. The sliding door slides in a direction along the length of the mini-van's body. The large sliding door accounts for a large expanse of the vehicles body structure. In an effort to cater to the comforts that consumers are accustomed, the mini-van manufacturers needed to do something with the interior portion of the large, boring, sliding door. In a car, such a large surface area would be occupied with glass, ventilation outlets, speakers, lights, locks, or other devices. So, mini-van manufactures wired the large sliding door with electrical devices such as a lock, speakers, anti-theft alarms, air blower motors, and etc. to make the mini-van more car-like. Then the following problem developed, how to supply the sliding door with electrical current? The manufactures solved this problem by providing an interruptible electrical connection between the sliding door and a pillar of the mini-van. When the sliding door is closed, the sliding door is adjacent to and abuts the pillar. When the sliding door is closed, electrical current is supplied to the sliding door. When the sliding door is not adjacent to and abutting the pillar, the sliding door is open. In the open position, no electricity flows to the sliding door.

Manufacturers accomplished this feat by providing an electrically conductive contact plate on the pillar and electrically conductive, spring-loaded, plungers mounted on the sliding door. When the sliding door is closed, the plungers butt-up against and contact the plate thereby making an electrical connection. The spring attached to the plunger allowed the plunger to move in a direction parallel to the sliding direction of the sliding door. As such, the plunger is held in a state of compression against the contact plate so as to ensure the electrical connection while the sliding door is closed. To accommodate tolerances and manufacturing variations, the contact position for each plunger on the contact plate is made large by providing a large contact plate. The large contact plate ensures that the plunger and plate make appropriate electrical contact.

The plunger/plate device described above has one drawback while in use: it commonly fails to perform its function over an extended period of time. The failure mode is known as fretting corrosion. Fretting corrosion is an especially insidious failure mode since it is difficult to detect until it is too late. Fretting corrosion is a combination of two separate failure modes, fretting and corrosion, which when combined together form a failure mode which is much worse than the separate effects of the separate failure modes added together individually.

Fretting has been defined as two bodies in contact with each other under load forming an interface, where vibration or repeated relative motion between the two bodies occur, and the load and the relative motion of the interface must be sufficient to produce slip or deformation of the surfaces. The fretting action typically causes the formation of debris which leads to the failure of the device, since the two bodies of the device may seize and gall, or have a loss of dimensional tolerances causing a loosening of components. Typically, the amount of relative motion is imperceptible, it is very small and is often overlooked. Overtime, and generally imperceptibly, material transfer and wear occurs until at some point in time the failure occurs. In the case of the plate/plunger device, the relative motion of the sliding door jarring about relative to the pillar causes the plungers to rub against the contact plate. Over time, the plungers wear through the contact plate and thus loose electrical conductivity between the two parts; or the contact plate is not completely worn away, but the components have lost enough material so as to form loosely fitting parts which, at best, provide intermittent electrical connection when the sliding door is in a closed position.

The corrosion component of fretting corrosion is what makes this failure mode so sinister. Corrosion, on its own, has been defined as the destruction or deterioration of a material because of reaction with its environment. Corrosion typically is classified as either wet corrosion or dry corrosion. Wet corrosion occurs when a liquid having electrolytes is present with the material. Dry corrosion occurs when no liquid is present in the environment. During the corrosion process, at the atomic level, for metallic materials, the material is oxidized thus forming oxides of the material, such as iron oxide, aluminum oxide, etc. The oxides are formed and either remain on the parts, are trapped between the parts, transferred between the surfaces, or are ejected from between the parts. In this case, when the sliding door of the mini-van is opened, the surfaces of the plungers and the contact plate are exposed to environmental elements, fluids, salt, gases, and etc. When the sliding door is closed, the environmental elements are trapped between or near the metallic plunger and metallic contact plate. On its own, over time, the corrosion process can cause failure of the plunger/plate device. The failure of the device is characterized by the loss of the non-interrupted electrical connection between the plunger and the contact plate when the sliding door is in the closed position.

However, in combination, the corrosion and fretting can cause much more damage more quickly. In the corrosion process described above, when the sliding door is closed and the mini-van drives about town, the sliding door moves relative to the pillar as described above in regard to the fretting failure mode. As the plungers move relative to the contact plate, the plungers wipe away the corrosion products and leave a clean surface of material exposed so as to be introduced into the corrosion process anew. Thus, each failure mode feeds one another, the corrosion produces more material to be transferred, the fretting constantly prepares a clean uncorroded surface ready for the corrosion process.

Thus, there is a need for a device making an electrical connection between the sliding door and the pillar of the mini-van that is not susceptible to the failure mode known as fretting corrosion.

SUMMARY OF THE INVENTION

It is an object of the invention to provide a sliding contact mechanism that minimizes fretting corrosion.

It is a further object of the invention to provide a mechanism which protects the contact zones from dust and other environmental contaminants.

It is another object of the invention to provide a mechanism which compensates for door and frame tolerances.

It is still yet another object of the invention to provide a mechanism which eliminates electrical interruption during driving of the vehicle.

It is another object of the invention to provide a mechanism which reduces the size of the device to accomplish the desired function.

It is still further another object of the invention to provide a mechanism which provides for an increased number of function within the existing hardware envelope.

It is another object of the invention to provide a mechanism having a minimum number of parts, where the parts are easy to assemble to one another thus decreasing the manufacturing and assembly costs.

In one form of the invention the sliding contact mechanism includes a sliding door contact, a spring having one end connected to the sliding door contact and another end connected to the sliding door of a mini-van, and a pillar contact attached to the stationary pillar of the mini-van. The pillar contact has a shape complementary to a shape of the sliding door contact. When the sliding door is in a closed position, the sliding door is adjacent the pillar and the sliding door contact engages and is in a closed electrical connection with the pillar contact. When the sliding door is in an open position, the sliding door is not adjacent the pillar and the sliding door contact is an open electrical connection with the sliding door contact.

In yet another form the invention, the sliding contact mechanism is mounted on a mini-van. The mini-van having a chassis, a motor mounted on the chassis, a pillar attached to the chassis, a sliding door slidably attached to the chassis, a spring attached to the sliding door, a sliding door contact attached to the sliding door, and a pillar contact attached to the pillar. The pillar contact having a shape complementary to a shape of the sliding door contact. The sliding door is adjacent the pillar when the sliding door is in a closed position. In the closed position the sliding door contact engages and makes a closed electrical connection with the pillar contact. The sliding door is not adjacent the pillar when the sliding door is in an open position. In the open position, the sliding door contact makes an open electrical connection with the sliding door contact.

Thus, the invention achieves the objectives set forth above. The invention provides an interruptible electrical connection between the sliding door and the pillar which is not as susceptible to fretting corrosion as is the conventional design.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 10 is a cross-sectional, side view of the sliding contact mechanism of FIG. 9 in a closed position;

FIG. 11 is a plan view of the pillar portion of the sliding contact mechanism;

DETAILED DESCRIPTION OF THE PRESENTLY PREFERRED EMBODIMENTS

Figure 1:
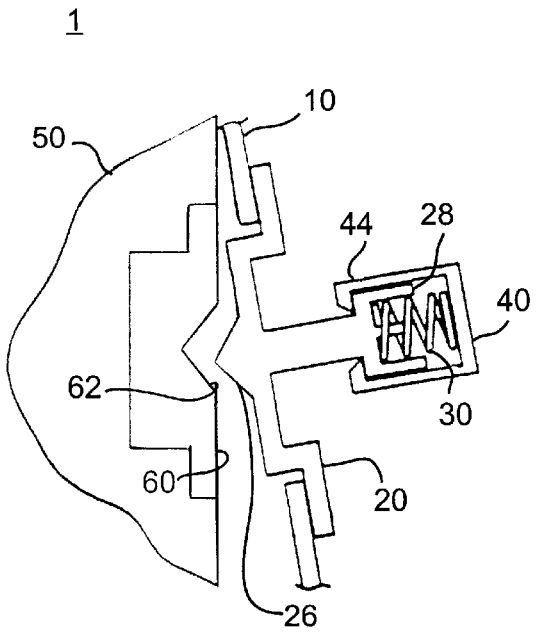
FIG. 1 is a cross-sectional, side view of the locating device of the sliding contact mechanism in an unclosed position.
Figure 2:
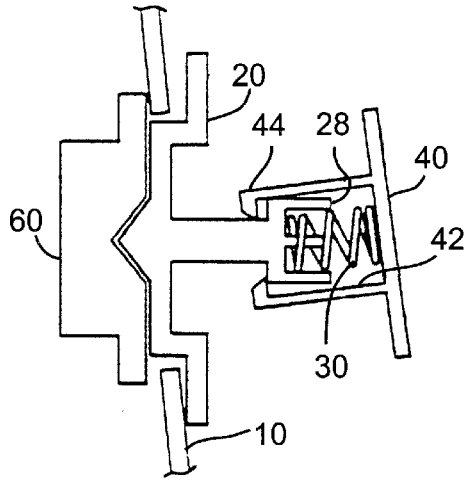
FIG. 2 is a cross-sectional, side view of the locating device of FIG. 1 in a closed position.

Referring now to the drawings, wherein like reference numerals designate identical or corresponding parts throughout the several views, and more particularly to FIGS. 1 and 2 thereof, an embodiment of the present invention is a sliding contact mechanism 1. FIG. 1 is a cross-sectional side view of a sliding door portion 10 and a stationary pillar portion 50 where the sliding contact mechanism 1 is in an open position.

The sliding door portion 10 includes a socket 40 fixedly attached to the frame of the sliding door portion 10, and a plunger 26 having a pivot portion 28. The pivot portion 28 is mounted in the socket 40. A plunger spring 30 is mounted between a portion of the socket 40 and the socket portion 28 of the plunger 26. The plunger spring 30 urges the plunger 26 away from the socket 40. The plunger or locating device pin 26 has a retaining ledge 20 which interacts with the frame of the sliding door that prevents the plunger 26 from being ejected out of the sliding door due to the force provided by the pre-load stored in the plunger spring 30. A portion of the pivot portion 28 retains the plunger spring 30. The plunger 26, the plunger spring 30, and the socket 40 are all made of electrically conductive materials and each component is electrically connected to the adjoining element. The socket 40 is further electrically connected to devices and components mounted in and on the sliding door of the vehicle.

The pillar portion 50 opposes the sliding door portion 10. The pillar portion 50 includes a stationary contact 60. The stationary contact 60 includes a locating surface 62. The stationary contact 60 is electrically connected to the vehicles electrical distribution system. As shown in FIG. 1, the sliding door portion 10 is mis-aligned relative to the stationary pillar portion 50.

FIG. 2 is a cross-sectional side view of a sliding door portion 10 and a stationary pillar portion 50 where the sliding contact mechanism 1 of FIG. 1 is shown in a closed position. In the closed position, a portion of the sliding door portion 10 abuts the pillar portion 50. Furthermore, the plunger 26 enters the locating surface 62 of the stationary contact 60 so as to make an electrical connection between the plunger 26 and the stationary contact 60. The pivot portion 28 of the plunger 26 translates and pivots relative to the socket 40. When the plunger 26 translates, the plunger spring 30 is compressed between the pivot portion 28 and the socket 40. The pivot portion 28 of the plunger is retained but not too constrained by an inner wall 42 of the socket 40. Additionally, the retaining ledge 20 is substantially removed from contact with the frame of the sliding door portion.

Figure 3:
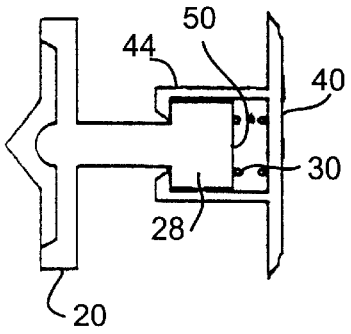
FIG. 3 is a cross-sectional, side view of an alternative pivot portion of the locating device pin of FIG. 1.

FIG. 3 is a cross-sectional view of another embodiment of a sliding door portion of the sliding contact mechanism. In this embodiment, the pivot portion 50 of the plunger has a substantially spherical shape which mates with the socket 40. The spherical pivot portion of the plunger remains in contact with the plunger spring 30. Additionally, the retaining ledge 20 has a rounded shape. Furthermore, the inner surface of the socket 40 retains the plunger spring 30.

Figure 4:
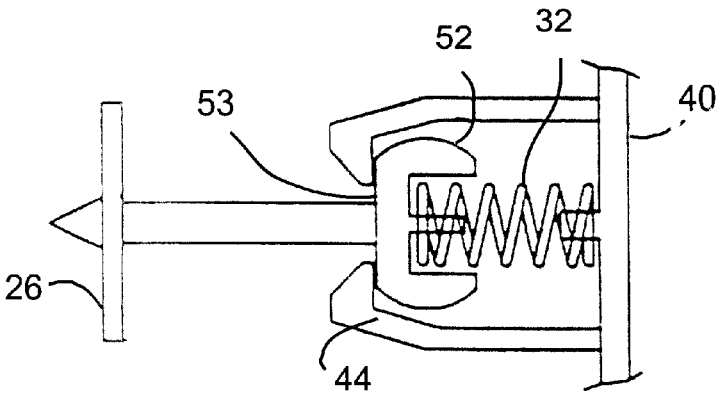
FIG. 4 is a cross-sectional, side view of another alternative pivot portion of the locating device pin of FIG. 1.

FIG. 4 is a cross-sectional view of another embodiment of a sliding door portion of the sliding contact mechanism. In this embodiment, the pivot portion 52 of the plunger 26 has a substantially spherical shape which mates with the socket 40. The spherical pivot portion 52 of the plunger remains in contact with the plunger spring 32 and also retains the plunger spring 32. The pivot portion 52 of the plunger 26 has a flat portion 53 which helps to align the plunger 26 relative to the sliding door portion when the sliding door is in the open position. The socket 40 has a conical portion at one end thereof.

Figure 5:
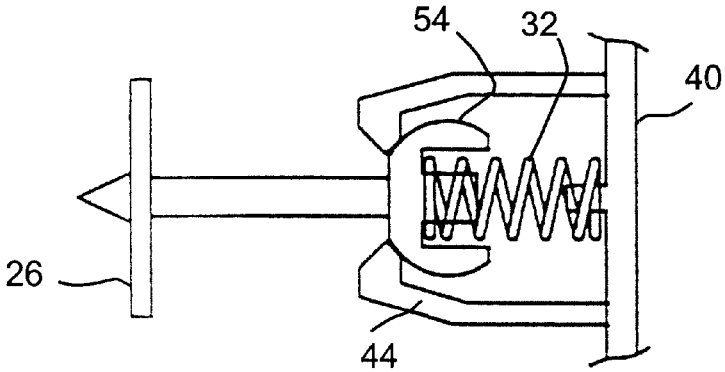
FIG. 5 is a cross-sectional, side view of still another alternative pivot portion of the locating device pin of FIG. 1.

FIG. 5 is a cross-sectional view of another embodiment of a sliding door portion of the sliding contact mechanism. In this embodiment, the pivot portion 54 of the plunger 26 has a substantially spherical shape which mates with the socket 40. The socket 40 does not have a conical portion, the socket 40 is substantially cylindrical.

Figure 6:
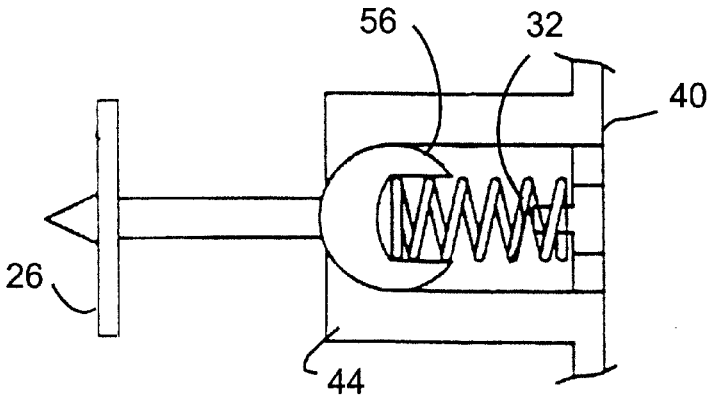
FIG. 6 is a cross-sectional, side view of yet still another alternative pivot portion of the locating device pin of FIG. 1.

FIG. 6 is a cross-sectional view of another embodiment of a sliding door portion of the sliding contact mechanism. In this embodiment, the pivot portion 56 of the plunger 26 has a substantially spherical shape which mates with the socket 40. The socket 40 has an end 44 which conforms to the shape of the pivot portion 56.

Figure 7:
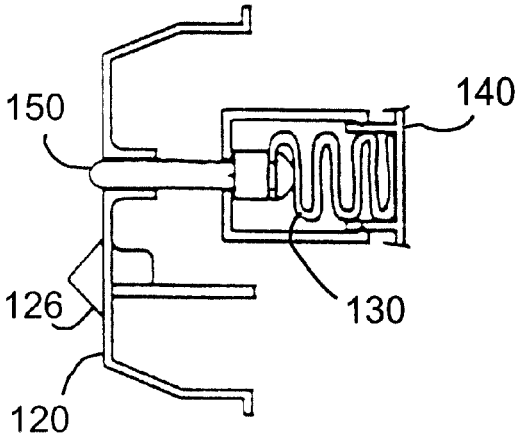
FIG. 7 is a cross-sectional, side view of the sliding door portion of the sliding contact mechanism.

FIG. 7 is a cross-sectional view of another embodiment of a sliding door portion of the sliding contact mechanism. In this embodiment, the plunger 150 is mounted to a plunger spring 130 which is in turn mounted in a socket 140. The plunger 150 is mounted in a location plate 120. The location plate 120 has a location point 126. The plunger 150 is electrically connected to the plunger spring 130 and the plunger spring 130 is electrically connected to the socket 140. The location plate 120 is electrically insulated from the plungers 150, plunger springs 130, and the leads 131. In use, the location point 126 mates with a corresponding structure on the pillar, when the sliding door is in the closed position, the location point 126 mates with the corresponding part of the pillar. The location point 126 registers or indexes the location plate 120 relative to corresponding structure on the pillar. Thus, the plunger 150 will mate-up with a corresponding stationary electrically contact located on the pillar when the sliding door is in the closed position.

Figure 8:
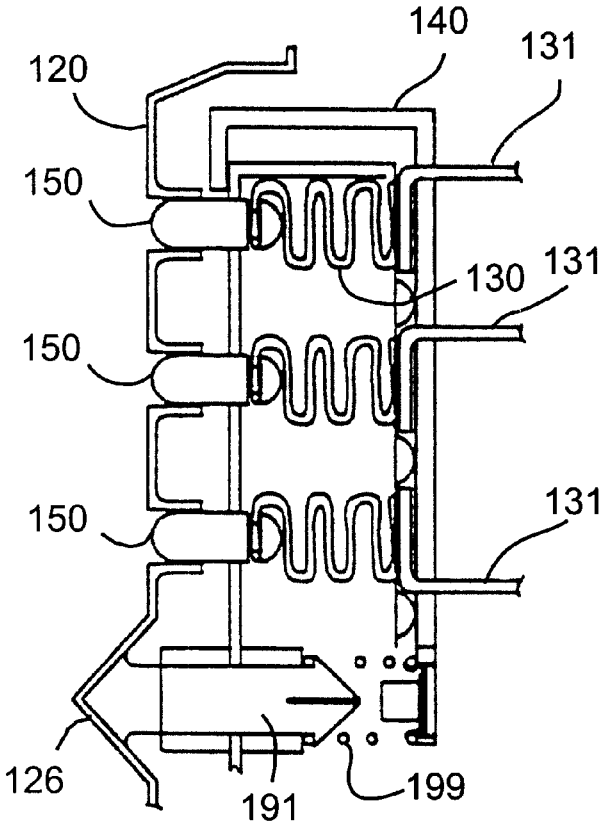
FIG. 8 is a cross-sectional, side view of the sliding door portion of the sliding contact mechanism showing multiple contact plungers.

FIG. 8 is a cross-sectional view of another embodiment of a sliding door portion of the sliding contact mechanism. In this embodiment, multiple plungers or contacts 150 are connected to respective plunger spring 130. Each plunger spring 130 is attached to a-respective contact or lead 131. The springs 130 when compressed react a force against the plungers 150 and a back plate 140. Each plunger 150 is slidably mounted in a location plate 120. The location plate 120 orients each plunger 150 relative to one another. The location plate 120 has a location point 126. The plunger 150 is electrically connected to the plunger spring 130 and the plunger spring 130 is electrically connected to the lead 131. The location plate 120 is able to translate relative to the back plate 140. A guide member 191 located within a center spring 199 when compressed provides a force against the back plate 140 and the location plate 120. The location plate 120 is electrically insulated from the plungers 150, plunger springs 130, and the leads 131.

In use, when the sliding door is in the open position, the location plate 120 prevents the plungers 150 from being exposed. Thus, it is more difficult for the plungers 150 to have environmental debris deposited thereon. However, the plungers 150 are not exposed and will not be able to touch the fixed contact on the stationary pillar when the sliding door is in the closed position. To overcome this problem, when the sliding door approaches the closed position, the location plate 120 abuts and contacts the corresponding structure on the pillar. When the sliding door is closed even further, the location plate 120 remains stationary, but the back plate 140 continues to translate, and, thus, the center spring 199 is compressed. While the back plate 140 translates, the plungers 150 also translate until the plungers 150 touch the stationary contacts of the pillar. Any remaining translation of the back plate 140 causes the plunger springs 130 to become compressed. At such a position, the sliding door is in a closed position. The location point 126 registers or indexes the location plate 120 relative to corresponding structure on the pillar. Thus, the plungers 150 will mate-up with corresponding stationary electrically contacts located on the pillar when the sliding door is in the closed position. Therefore, in this embodiment multiple electrical signals are conveyed through the sliding contact mechanism. As an example, some of the plungers may transmit power, and others may transmit data signals.

Figure 9:
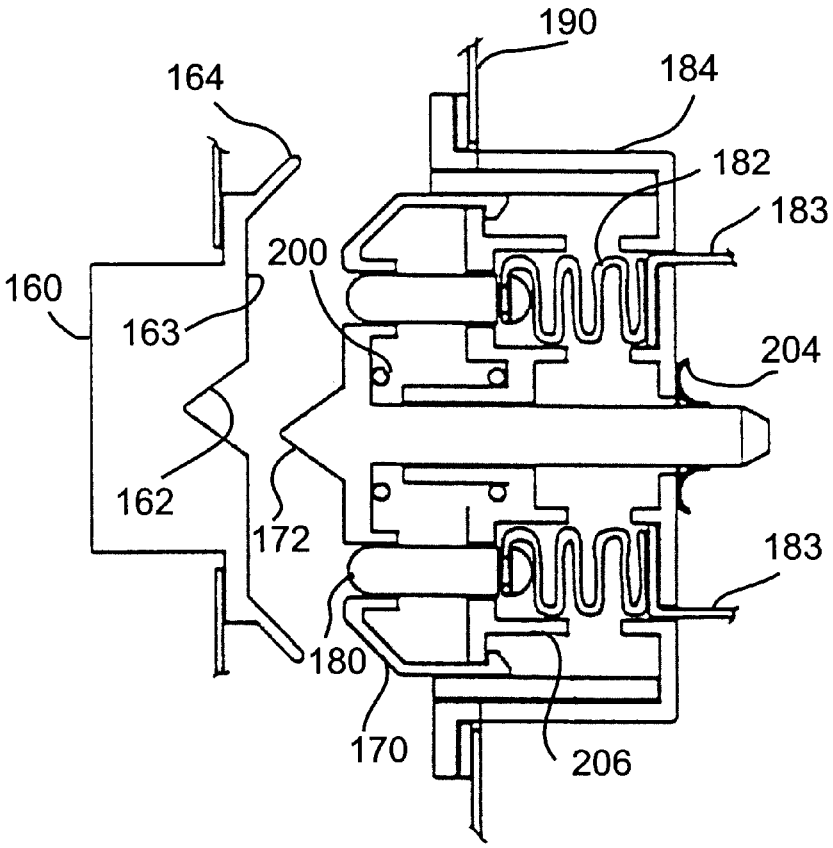
FIG. 9 is a cross-sectional, side view of the sliding contact mechanism in an unclosed position or open position.

FIG. 9 is a cross-sectional view of another embodiment of the sliding contact mechanism where the sliding door is in the open position. In this embodiment, the sliding door contact 190 includes multiple plungers or contacts 180 are connected to respective plunger springs 182. Each plunger spring 182 is attached to a respective contact or lead 183. The plunger springs 182, when compressed, provide a force which is reacted against the plungers 180 and a back plate 184. A seal 204 prevents environmental contaminants from entering the gap between the back plate 184 and a shaft of the location plate 170. Each plunger 180 is slidably mounted in a location plate 170. The location plate 170 orients each plunger 180 relative to one another. The location plate 170 has a location point 172 which mates with the location indentation 162 of the pillar contact 160. The pillar contact 160 includes a guide surface 164 and a contact surface 163. The location plate 170 is able to translate relative to the back plate 184. A center spring 200, when compressed, provides a force against a middle plate 206 and the location plate 170. The middle plate translates relative to the location plate 170 and the back plate 184. The force provided by the center spring 200 then flows through the middle plate 184 and travels down the plunger springs 182 and is reacted by the back plate 184. The plunger 180 is electrically connected to the plunger spring 182 and the plunger spring 182 is electrically connected to the lead 183. The location plate 170 is electrically insulated from the plungers 180, plunger springs 182, and the leads 183.

In use, when the sliding door is in the open position, the location plate 170 prevents the plungers 180 from being exposed. Thus, it is more difficult for the plungers 180 to have debris adhered and accumulated on the surface of the plungers 180. In order for the plungers 180 to become exposed, when the sliding door approaches the closed position, the location plate 170 abuts and contacts the contact surface 163 of the pillar contact 160. When the sliding door is closed even further, the location plate 170 remains stationary, nut the back plate 184 and the middle plate 206 continue to translate, and, thus, the center spring 200 is compressed. While the back plate 184 and the middle plate 206 translate, the plungers 180 also translate until the plungers 180 touch the contacts of the pillar contact 160. Any remaining translation of the back plate 184 causes the plunger springs 182 and the center spring 200 to become even further compressed. Choices in spring rate and stiffness of the springs determine the amount of translation of the back plate 184 relative tot he middle plate 206. At such a position, the sliding door is in a closed position. The location point 172 registers or indexes the location plate 170 relative to corresponding structure on the contact pillar 160. Thus, the plungers 180 will mate-up with corresponding stationary electrically contacts located on the pillar when the sliding door is in the closed position. Therefore, in this embodiment multiple electrical signals are conveyed through the sliding contact mechanism. As an example, some of the plungers may transmit power, and other plungers may transmit data signals.

FIG. 10 is a partial cross-sectional, side view of the sliding contact mechanism of FIG. 9 shown in the closed position. The location plate 170 touches the pillar contact 160. The plungers 180 are fully engaged in respective pillar contact cups or plunger receptacles 218 which are spring loaded so as to provide a secure connection. The contact cups 218 include flared ends 219.

FIG. 11 is a plan view of the pillar contact 160 of the pillar portion of FIGS. 9 and 10. Attachment locations 226 allow screws or bolts or rivets to mount the pillar contact 160 to the pillar of the vehicle. The pillar contact cups or plunger receptacles 218 correspond and are arranged to mate-up with the plungers of the sliding door contact. The location indentation 162 is the central feature from which other components are measured or indexed. Also shown is the guide surface 164.

Figure 12:
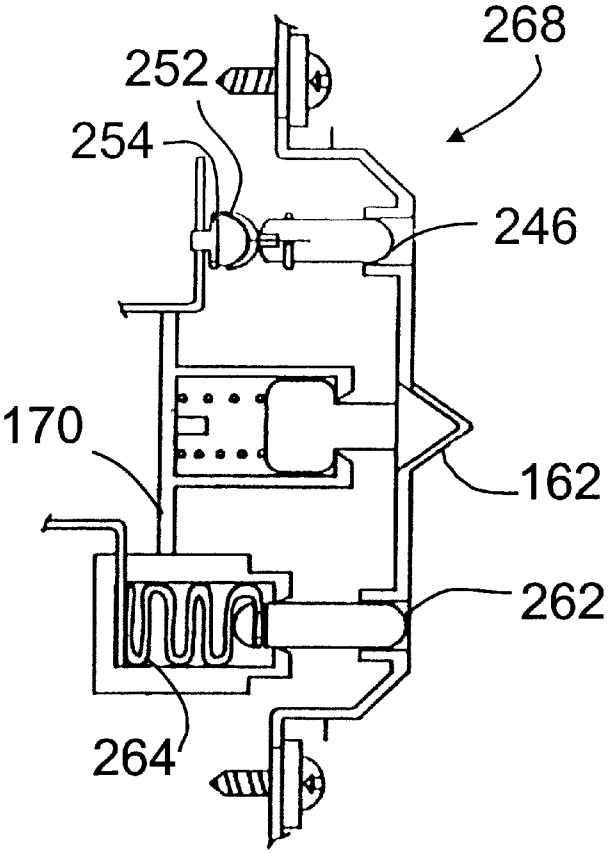
FIG. 12 is a cross-sectional, side view of the sliding door portion of the sliding contact mechanism showing alternative connections of the plungers to the plunger springs.

FIG. 12 is a cross-sectional side view of a sliding door contact 268 displaying two different plunger contacts. The first plunger 246 is connected to a lead or contact by way of a spring 254 and a spherical pivot 252. The second plunger 262 is connected to a flat spring 264.

Figure 13:
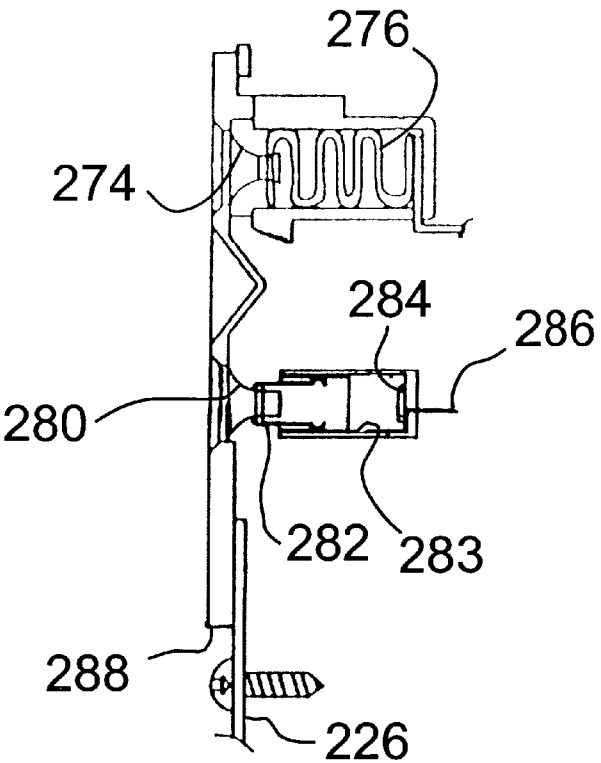
FIG. 13 is a cross-sectional, side view of the pillar portion of the sliding contact mechanism showing alternative connections of the plunger receptacles to the plunger receptacle springs.

FIG. 13 is a cross-sectional side view of a pillar contact 288 displaying two different pillar contact cups or plunger receptacles. The first cup 274 is connected to a flat spring 276. The second cup 280 has sliding members 282 which touch and slide against an inner surface 283 of the housing. A lead 286 is connected to the inner surface 283. A spring 284 provides a force to urge the cup 280 away from the lead 286.

Figure 14:
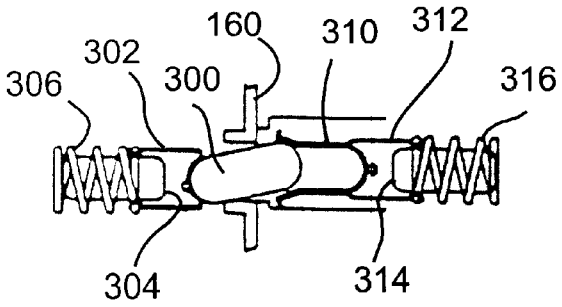
FIG. 14 is a side view of the plunger and plunger receptacle in the closed position.

FIG. 14 is a cross-sectional side view of a plunger 300 of a sliding door contact connecting with a cup or plunger receptacle 310 of a pillar contact in a closed door position. The plunger 300 is attached to a sliding contact 302. The sliding contact 302 slides against a pin 304 so as to make an electrical connection between the two elements. A spring 306 is also attached to the sliding contact 302 so as to urge the plunger 300 toward the cup or plunger receptacle 310. The cup 310 is also attached to a sliding contact 312. The sliding contact 312 slides against a pin 314 so as to make an electrical connection. A spring 316 is also attached to the sliding contact 312 so as to urge the cup 310 toward the plunger 300.

Figure 15:
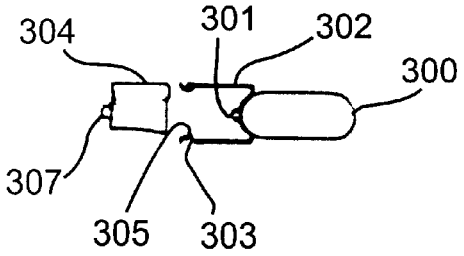
FIG. 15 is side view of the plunger of FIG. 14.

FIG. 15 is a side view of the plunger 300 of FIG. 14. The plunger 300 is attached to the sliding contact 302 by a rivet or by upsetting or staking 301 the end of the plunger 300. The sliding contact 302 a sliding surface 305 which is squeezed about the pin 304 by a spring 303. The pin 304 is attached to structure of the sliding door by a rivet or by upsetting or by staking 307 an end of the pin 304.

Figure 16:
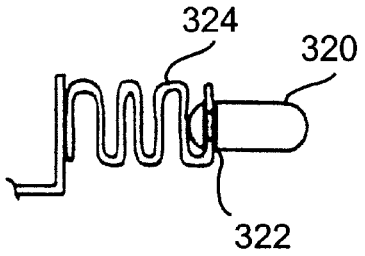
FIG. 16 is a side view of the plunger showing another alternative attachment.

FIG. 16 is a side view of another type of plunger 320 attached to a flat spring 324. The plunger 320 has a recess 322 which slips into a receiving portion of the flat spring 324 and is held in place by an interference fit between the two parts.

Figure 17:
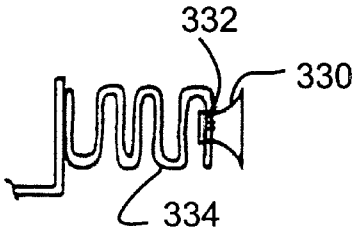
FIG. 17 is a side view of the plunger receptacle with an alternative attachment.

FIG. 17 is a side view of another type of plunger receptacle or cup 330 attached to a flat spring 334. The cup 330 has a small diameter portion 332 which slips into a receiving portion of the flat spring 334 and is held in place by an interference fit between the two parts.

Figure 18:
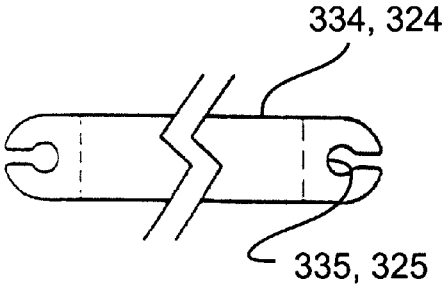
FIG. 18 is a partial end view of the flat spring shown in FIGS. 16 and 17.

FIG. 18 is a partial end view of the flat springs 334, 324 shown in FIGS. 16 and 17. The receiving portion 335, 325 of each respective flat spring is clearly shown. As discussed above, the receiving portion 325 of flat spring 324 accepts the recess 322 of plunger 320, and the receiving portion 335 of flat spring 334 accepts the small diameter portion 332 of the cup 330.

Obviously, numerous modifications and variations of the present invention are possible in light of the above teachings. It is therefore to be understood that within the scope of the appended claims, the invention may be practiced otherwise than as specifically described herein.

What is claimed is:

1. A sliding contact mechanism comprising:

a moving contact;

a first spring connected to the moving contact; and a stationary contact having a contact mating surface having a shape complementary to a shape of the moving contact; and wherein the moving contact engages and is in a closed electrical connection with the stationary contact when the contact mechanism is in a closed position, and wherein the moving contact moves in a direction generally perpendicular to the contact mating surface of the stationary contact when the contact mechanism is moved from an open position to the closed position, and wherein, in the closed position, the first spring is compressed and reacts a force against the moving contact in order to abut and electrically contact the stationary contact.

2. The sliding contact mechanism according to claim 1, further comprising a second spring connected to the stationary contact, and wherein the second spring is compressed when the contact mechanism is in the closed position.

3. The sliding contact mechanism according to claim 2 wherein the first spring is a plunger spring.

4. The sliding contact mechanism according to claim 3 wherein the second spring is a plunger spring.

5. The sliding contact mechanism according to claim 4 wherein the stationary contact has a shape of a cup.

6. A sliding contact mechanism comprising:

a sliding door contact;

a first spring having one end connected to the sliding door contact and another end connected to a sliding door of a vehicle; and a pillar contact mounted on a pillar of the vehicle, the pillar contact having a shape complementary to a shape of the sliding door contact, and wherein the sliding door contact engages and is in a closed electrical connection with the pillar contact when the sliding door is in a closed position, and wherein the pillar contact makes an open electrical connection with the sliding door contact when the sliding door is in an open position, and wherein, in the closed position, the first spring is compressed and reacts a force against the sliding door contact in order to abut and electrically contact the pillar contact.

7. The sliding contact mechanism according to claim 6, further comprising a second spring having one end connected to the pillar contact and another end connected to the pillar of the vehicle, and wherein the second spring is compressed when the contact mechanism is in the closed position.

8. The sliding contact mechanism according to claim 7 wherein the first spring is a plunger spring.

9. The sliding contact mechanism according to claim 8 wherein the second spring is a plunger spring.

10. The sliding contact mechanism according to claim 9 wherein the stationary contact has a shape of a cup.

11. A sliding contact mechanism comprising:

a moving contact, the moving contact comprising, a location plate having a location point, a middle plate retained by the location plate, a first plunger slidably mounted in the location plate and the middle plate, a first spring urging the location plate away from the middle plate, a back plate, a second spring connected to the first plunger and to the back plate, and wherein the second spring urges the first plunger away from the back plate, and a first lead attached to the back plate, and wherein the first lead is electrically connected to the first plunger; and a pillar contact, the pillar contact comprising, a pillar contact body having a contact surface, a location indentation, and a guide surface, a first plunger receptacle slidably mounted in the pillar contact body, and a third spring connected to the first plunger receptacle and to the pillar contact body, and wherein, in a closed position, the moving contact abuts the pillar contact so as to make an electrical connection between the first plunger and the first plunger receptacle.

12. The sliding contact mechanism according to claim 11 wherein the second spring is a plunger spring.

13. The sliding contact mechanism according to claim 12 wherein the third spring is a plunger spring.

14. The sliding contact mechanism according to claim 13 wherein the first plunger receptacle has a shape of a cup.

15. The sliding contact mechanism according to claim 14, further comprising a second plunger and a second plunger receptacle.

16. The sliding contact mechanism according to claim 15 wherein the first plunger and the second plunger being positioned equal distances from the location point.

17. The sliding contact mechanism according to claim 16 wherein the first plunger receptacle and the second plunger receptacle being positioned equal distances from the location indentation.

18. The sliding contact mechanism according to claim 17 wherein, when in the closed position, the first plunger contacts the first plunger receptacle, and the second plunger contacts the second plunger receptacle.

19. The sliding contact mechanism according to claim 18 wherein the first plunger is located one-hundred-eighty degrees away from the second plunger about the location point, and wherein the first plunger receptacle is located one-hundred-eighty degrees away from the second plunger receptacle about the location indentation.

* * * * *